United States Patent [19]

Daus, Jr.

[11] Patent Number: 4,935,995

[45] Date of Patent: Jun. 26, 1990

[54] FABRIC JUNCTURE ASSEMBLY

[75] Inventor: John J. Daus, Jr., Evansville, Ind.

[73] Assignee: Anchor Industries, Inc., Evansville, Ind.

[21] Appl. No.: 302,557

[22] Filed: Jan. 27, 1989

[51] Int. Cl.[5] ..... A41F 1/00

[52] U.S. Cl. ..... 24/573.1; 24/453; 160/351; 160/392

[58] Field of Search ..... 24/573, 453, 287, 394, 24/389; 160/392, 395, 351, 135

[56] References Cited

U.S. PATENT DOCUMENTS

| | | | |
|---|---|---|---|
| 684,113 | 10/1901 | Shaddle | 160/392 |
| 2,526,912 | 10/1950 | Swanson | 160/392 |
| 2,897,889 | 8/1959 | Kessler | 160/392 |
| 3,066,501 | 12/1962 | Charles et al. | 24/573 |
| 3,460,282 | 8/1969 | Swirsky | 24/573 |
| 3,537,153 | 11/1970 | Ausnit | 24/573 |
| 3,875,623 | 4/1975 | Johnston | 24/573 |
| 4,047,337 | 9/1977 | Bergstrom | 160/351 |
| 4,218,047 | 8/1980 | Douglas | 24/573 |
| 4,785,565 | 11/1988 | Kuffner | 160/135 |
| 4,830,080 | 5/1989 | Densen | 160/351 |

FOREIGN PATENT DOCUMENTS

| | | | |
|---|---|---|---|
| 26633 | of 1909 | United Kingdom | 160/392 |
| 1165725 | 10/1969 | United Kingdom | 160/395 |

*Primary Examiner*—Victor N. Sakran

*Attorney, Agent, or Firm*—Warren D. Flackbert

[57] ABSTRACT

A fabric juncture assembly comprising an interlock and connectors, where the fabric panels are secured to the latter. Assembly is assured by a male-female latching mode variously presented along adjacent edges of the interlock and the connectors. As a result, a secured relationship is positively achieved between the interlock and the connectors and, at the same time, a watertight relationship.

4 Claims, 1 Drawing Sheet

10
2
2
11
30
30
12
11a
11a
12

11a
30
12a 11a
30
12a 30
25
25a 12a
12a
11
30
12
11a'
11a
11a'
11a 30
21a
22a'
21
22a
30
22
22a
22a'
21a
22'

20
22a
21
30
30
4
4
22'
22a

FABRIC JUNCTURE ASSEMBLY

As is known, and particularly in the instance of canopy and/or tent erection, it is desirable to achieve the assembly of tent fabric, which may be a canvas or plastic material, in both a waterproof and positive relationship. The invention has accomplished the preceding objective in presenting a juncture assembly characterized as a panel interlock in combination with mating fabric edge connectors.

BRIEF DESCRIPTION OF THE INVENTION

The aforesaid assembly is accomplishable in two forms which attain the same end result, i.e. where the panel interlock has edge portions each adapted to receive a connector disposed along the edge of an adjacent fabric panel or a panel interlock having edge portions each adapted to be received within a connector disposed along the edge of an adjacent fabric panel. In either instance, the received component may be longitudinally ribbed for strength and/or line contact.

DESCRIPTION OF THE FIGURES

In any event, the completed assembly achieves a waterproof and positive juncture, where a better understanding of the invention will become more apparent from the following description, taken in conjunction with the accompanying drawing, wherein.

Figures 1, 2, 3, 4, 5, 6, 7:
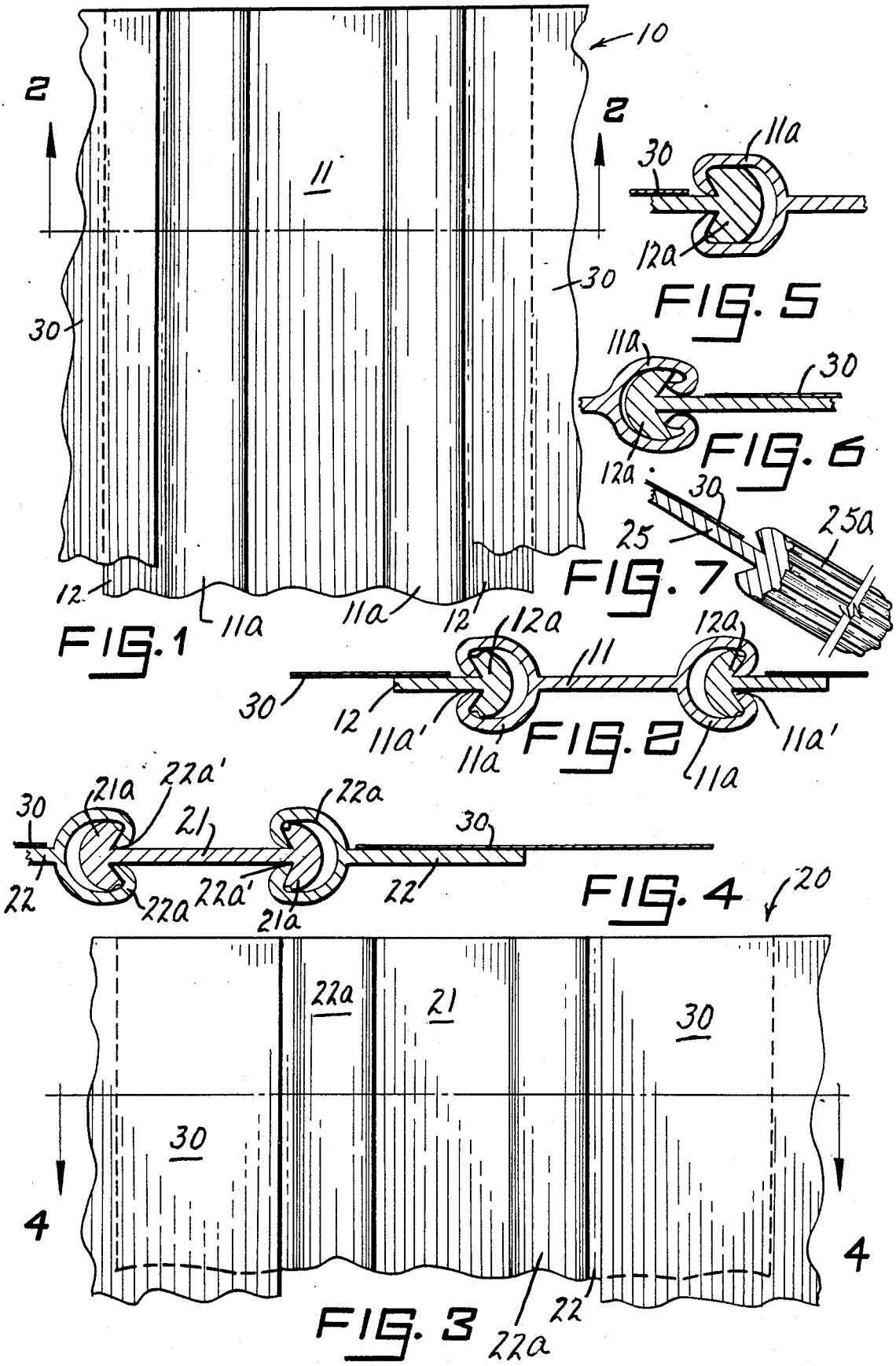
FIG. 1 is a top plan view, partly fragmentary, of one form of fabric juncture assembly in accordance with the teachings of the present invention.
FIG. 2 is a view in vertical section, taken at line 2—2 on FIG. 1 and looking in the direction of the arrows, detailing such invention form.
FIG. 3 is another top plan view, partly fragmentary, of an alternative fabric juncture assembly in accordance with the teachings of the present invention.
FIG. 4 is a view in vertical section, taken at line 4—4 on FIG. 3 and looking in the direction of the arrows, such alternative invention form.
FIG. 5 is a view in vertical section showing another configuration forming part of the invention and usable therewith.
FIG. 6 is another view in vertical section showing a still further configuration forming part of the invention; and, FIG. 7 is a perspective view showing yet another component configuration presented by the invention.

For the purposes of promoting an understanding of the principles of the invention, reference will now be made to the embodiments illustrated in the drawing and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Referring now to the figures, and particularly FIGS. 1 and 2, one fabric juncture assembly 10 in accordance with the teachings of the invention is defined by an interlock 11 in the form of a strip having receiving portions 11*a*, and entry slots 11*a*', disposed and/or formed along opposing edges thereof. The portions 11*a* are each adapted to receive an enlarged edge 12*a* of a mating connector 12 onto which tent fabric 30 is secured, the latter by stitching and/or radio frequency welding, for example. In other words, the relationship between the interlock 11 and the connectors 12 define a male-female combination.

Another form of juncture assembly 20 in accordance with the teachings of the invention is disclosed in FIGS. 3 and 4, wherein, in this instance, the interlock 21 presents enlarged edge portions 21*a* along opposing sides thereof. Edge portions 21*a* are each adapted to be received within a portion 22*a*, through an entry slot 22*a*', defining an edge of a connector 22, where fabric panel 30 is stitched or welded onto the latter. Again, a male-female combination is evident.

In any event, it should be understood that the interlocking relationship presented by either invention form should be sufficiently rigid so as to prevent any unwanted opening of the entry slots 11*a*' and 22*a*', and, ultimately, fabric panel 30 separation. The preceding serves as an effective substitute for conventional tent lacing, a slide fastener or zipper, or other means for joining fabric panels. Moreover, not only is a satisfactory juncture provided, but the invention also eliminates the need for using a supplementary overflap to accomplish water resistance purposes, as is oftentime the instance. Assembling of the fabric panels herein into a use condition may be typically accomplished by sliding action.

As evident particularly from FIGS. 2 and 4, strength is achieved by the internal configuration of the mating portions of both the interlock and the connectors, where such include angling inner surfaces which, at a use condition, bear against other correspondingly shaped angled inner surfaces to achieve positive securement. As visually apparent, acute angle relationships against the fabric panel pulling force or separation assures positive fabric panel juncture.

Other forms of mating configuration (bearing like reference numerals) are disclosed in FIGS. 5 and 6 and are self-evident, while FIG. 7, generally similar to FIG. 2, shows an enlarged portion 25 which includes longitudinally extending ribs 25*a*, the latter serving strength and/or in-line pressure purposes.

From the preceding, it should be apparent that the invention achieves positive juncture of fabric panels typically used in connection with tents, canopies or the like. The instant juncture is readily assembled, is watertight, and provides the necessary strength without the need for extra operational sealing steps during assembly.

The fabric juncture assembly described hereabove is susceptible to various changes within the spirit of the invention, including, by way of example, in proportioning, e.g. the width of the interlock; the internal (and external) configuration of the received portions defining the juncture - exemplified by FIGS. 2, 5 and 6; the particular selection of material involved for either the interlock and/or the connectors; and, the like. Thus, the preceding description should be considered illustrative and not as limiting the scope of the following claims:

I claim:

1. A fabric juncture assembly in the form of an elongated generally flat strip with oppositely facing longitudinal edges, each of said longitudinal edges presenting a cavity serving receiving and retaining purposes and including an entry slot arranged to prevent unwanted opening, and elongated edge strips each presenting a flattened portion secured to fabric and opening into a ribbed enlarge longitudinal edge selectively adapted to be received and retained within one of said cavities in a waterproof and positive juncture.

2. The fabric juncture assembly of claim 1 wherein said cavity and said enlarged longitudinal edge present angled flat surfaces of one bearing against correspondingly shaped angled flat surfaces of the other.

3. A fabric juncture assembly in the form of an elongated generally flat strip with oppositely facing enlarged longitudinal edges, and elongated edge strips each presenting a flattened portion secured to fabric and opening into an enlarged cavity and along a ribbed longitudinal edge thereof serving receiving and retaining purposes and including an entry slot arranged to prevent any unwanted opening, where each of said cavities is adapted to selectively receive and retain one of said enlarged longitudinal edges of said strip in a waterproof and positive juncture.

4. The fabric juncture of claim 3 where said cavity and said enlarged longitudinal edge present angled flat surfaces of one bearing against correspondingly shaped angled flat surfaces of the other.

* * * * *